US005220612A

United States Patent [19]

Tibbetts et al.

[11] Patent Number: 5,220,612

[45] Date of Patent: Jun. 15, 1993

[54] NON-OCCLUDABLE TRANSDUCERS FOR IN-THE-EAR APPLICATIONS

[75] Inventors: George C. Tibbetts; Peter L. Madaffari, both of Camden, Me.

[73] Assignee: Tibbetts Industries, Inc., Camden, Me.

[21] Appl. No.: 812,572

[22] Filed: Dec. 20, 1991

[51] Int. Cl.[5] ..... H04R 25/00

[52] U.S. Cl. ..... 381/68; 381/69; 381/23.1; 381/68.6

[58] Field of Search ..... 381/68, 23.1, 68.6, 381/69.2, 68.3, 69, 151, 60; 73/585; 181/132, 130, 129, 135

[56] References Cited

U.S. PATENT DOCUMENTS 4,739,512 4/1988 Hartl et al. ..... 381/68.6

4,800,982 1/1989 Carlson ..... 181/130

*Primary Examiner*—Jin F. Ng

*Assistant Examiner*—Sinh Tran

*Attorney, Agent, or Firm*—Lahive & Cockfield

[57] ABSTRACT

An in-the-ear electroacoustic transducer is constructed to limit the effect of accretion of cerumen on acoustically active surfaces: to prevent cerumen from plugging passages for acoustical energy to the tympanic membrane and to facilitate the removal of cerumen from the transducer by the user. A casing has a hollow tubular wall, and diaphragm means is mounted to the casing near one end thereof, the casing being shaped for insertion in the ear to define a space generally bounded by the ear canal, the tympanic membrane and the diaphragm means. The diaphragm means has a flexible film surround, and stop means are provided to limit its movement inwardly of the casing. The transducer can be incorporated in or utilized as various hearing aids respectively adapted for different depths of insertion within the ear canal.

29 Claims, 8 Drawing Sheets

NON-OCCLUDABLE TRANSDUCERS FOR IN-THE-EAR APPLICATIONS

SUMMARY OF THE INVENTION

This invention relates generally to electroacoustic transducers intended to be worn in the ear of the user, where the excretions that occur in the ear tend to enter any orifice or outlet passage that is utilized to introduce sound into the user's ear canal. In many prior art hearing aids incorporating such transducers, build-up of these excretions, referred to as ear wax or cerumen, ultimately blocks all or part of the sound outlet passage, causing a malfunction of the hearing aid.

U.S. Pat. No. 4,800,982 issued Jan. 31, 1989 to Elmer V. Carlson discloses a hearing aid having a cleaning passage, a part of which comprises the sound outlet passage. Cleansing is effected by pumping a solvent through the cleaning passage. Numerous other U.S. patents have issued on a variety of wax or cerumen traps or guards, so-called, and many such traps are in use in commercial in-the ear hearing aids, including in-the-canal aids. Such traps are only partially effective. In the worst case, extended use without adequate cleaning results in irreversible plugging of the acoustic outlet of the output transducer within the hearing aid, and in complete failure of the hearing aid in use. In the best case, the particular trap plugs quite rapidly, and the performance of the hearing aid degrades until cleaning or trap replacement is repeated, the result being variable performance over its life.

Such wax plugging is reputed within the hearing aid industry to be the primary cause of field failure of in-the-ear and canal aids, associated with high rates of return to the manufacturer even within the first year of use.

Similar wax plugging problems are found in other industries which employ miniature electroacoustic transducers within or adjacent the ear canal. An example is the light weight telephone headset industry.

An object of this invention is to limit the effect of accretion of cerumen on acoustically active surfaces, and specifically to provide structures that prevent cerumen from plugging passages for acoustical energy to the tympanic membrane.

Another object is to enable the cleaning of cerumen from the transducer by the wearer without damage to its working parts.

With the foregoing and other related objects in view, the present invention provides a transducer in which the outward face of the acoustic diaphragm is placed directly within the ear canal, and there are, preferably, no intermediate passageways that can be plugged. Cerumen that becomes deposited on the diaphragm is cleanable therefrom, by the end user, by means of a brush or other suitable tool. In order to withstand such relatively rough and uncontrolled handling at its exposed diaphragm face, the transducer must have unprecedented ruggedness against such handling, while at the same time possessing the high acoustic compliance (commensurate with the acoustic compliance of its internal air cavities) necessary for efficient transduction between electrical and acoustic signals.

These requirements are satisfied by providing a transducer casing which extends along the ear canal and is at least partially sealed thereto, an atmospheric pressure vent at its outer end remote from sources of ear excretions, and an acoustic diaphragm of particular structure which completely or substantially closes a face or surface of the casing near its inner end, toward the tympanic membrane. The acoustic diaphragm is attached to an electromechanical motor unit within the casing which may have electrical terminals on or extending through the casing. The acoustic diaphragm has a central portion which vibrates substantially as a piston, at least at lower signal frequencies, and also has a film surround which seals to the casing or an adjacent structure sealed to the casing. Preferably the film of the surround provides the entire exposed surface of the diaphragm and is sealed near its periphery between a wall of the casing and a supporting structure within the casing. The surround is formed to conserve substantially the very high mechanical compliance of the diaphragm surround under substantial vibration excursions, as is conventional in many electroacoustic transducers. The film is formed inwardly toward the interior of the casing to provide elastic stability and strength to the surround under the external pressure of end-user cleaning operations.

Because of the very small diaphragm area available transverse to the ear canal, the mechanical compliance of the electromechanical motor unit itself must also be very high, to provide the required acoustic compliance of the overall transducer. The forces generated by the physical pressure of end-user cleaning, when applied to a structure having such a high mechanical compliance would cause very large deflections of the diaphragm, resulting in tearing of the surround or destruction of the motor unit. To prevent such undue deflections, a mechanical stop is provided to the diaphragm but does not affect the operation during normal signal vibrations of the diaphragm. In some structures, the mechanical stop function ma be provided by the electromechanical motor unit itself.

In one type of hearing aid incorporating transducers of the present invention, the diaphragm of the transducer may be substantially flush mounted with the inner end of the hearing aid toward the tympanic membrane of the ear. The manufacturer may provide a temporary cap for the transducer to protect it during storage or handling of the hearing aid when not in use. He may alternatively provide a perforated cap to protect the transducer during use, or to modify its frequency response. If so, the cap must be at least partially removable for cleaning or replacement.

The transducers of this invention may also be used to construct a new type of deep insertion canal aid. In these structures the casing of the transducer extends well beyond the inner end of the nominal shell of the hearing aid, deeper into the ear canal, and has its own seal to the ear canal, near the diaphragm end of the transducer.

DETAILED DESCRIPTION

Figure 1:
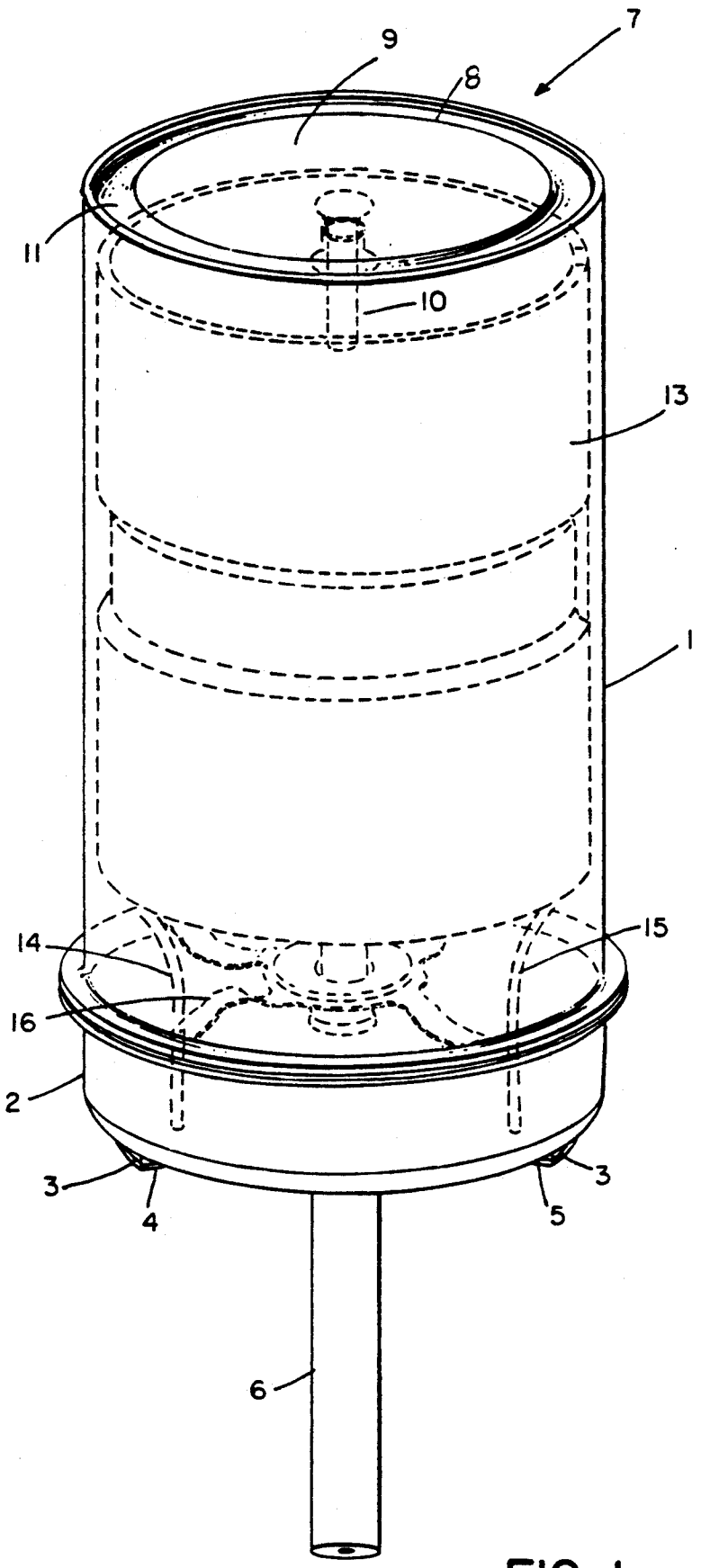
FIG. 1 is a composite view of a first embodiment of a transducer according to the invention.
Figure 3:
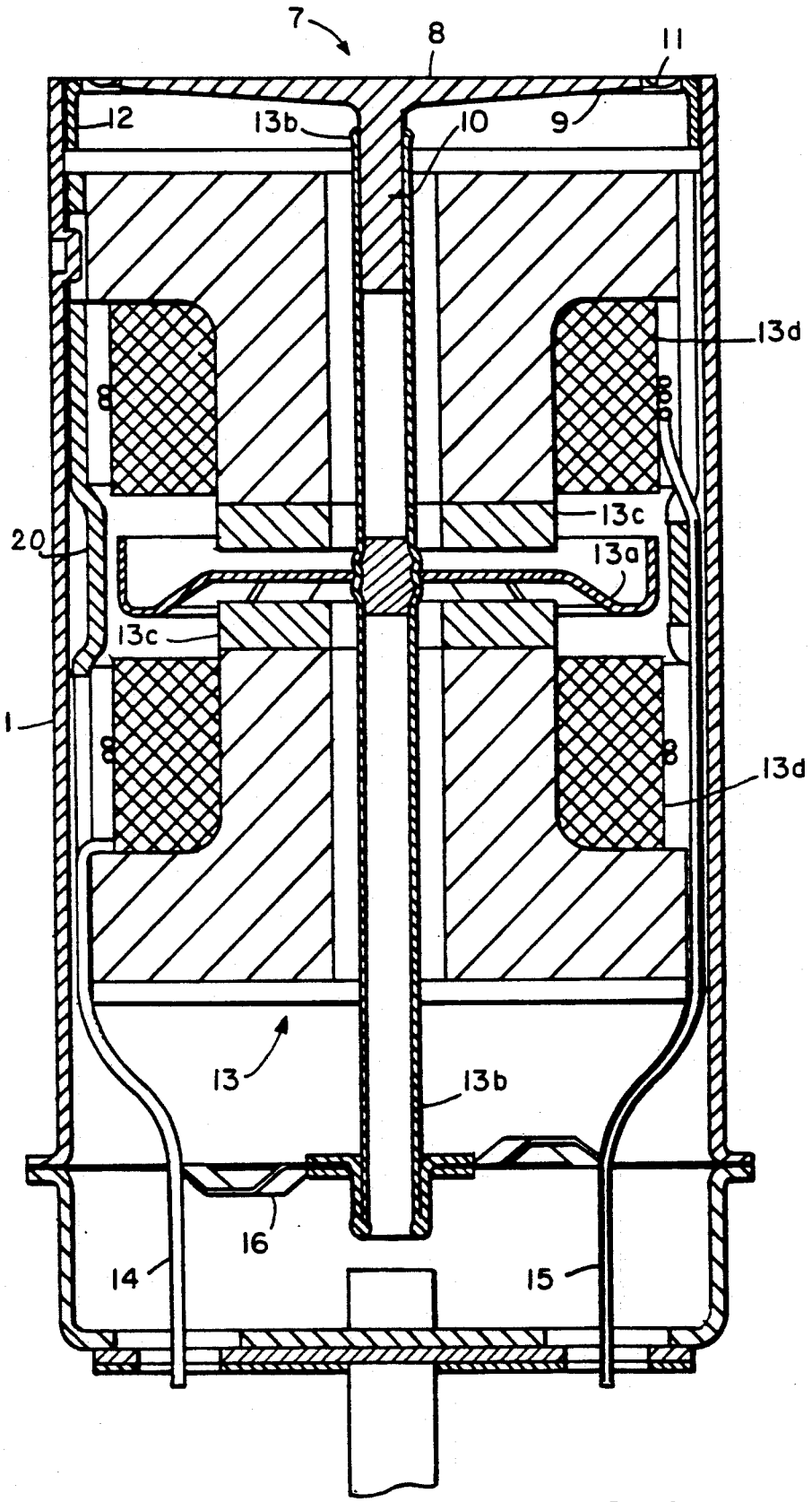
FIG. 3 is a complete elevation in longitudinal diametric section of the first embodiment, having an intrinsic form of mechanical stop means.

FIG. 1 shows a complete transducer according to the present invention. In this invention, a casing member has a wall of hollow tubular shape. In FIG. 1 it is substantially cylindrical and of circular cross section, and comprises a flanged tube 1 which is substantially closed at one end by a flanged terminal cup 2. The wall of the tube 1 forms a circular rim at its end opposite the cup 2. The flanges are welded together, the welds extending through an optional structural part 16 fixed between the flanges, hereinafter described in connection with FIG. 3. The cup 2 carries a terminal board 3, which has electrical terminal pads 4 and 5. An atmospheric vent 6 passes through an aperture in the cup 2 and is adhesive bonded thereto. A diaphragm assembly 7 closes the opposite end of the tube 1 and is sealed to it by adhesive. The diaphragm assembly 7 has a central portion 8 which is provided by a substantially circular diaphragm reinforcement 9 with its peripheral edge spaced from the wall of the casing. The reinforcement 9 is a hot extrusion or forging of age hardenable high strength aluminum alloy, and has an integral stem 10. High strength, thin flexible polymer film, typically a 1.5 to 2.5 micron thick biaxially oriented polyethyleneterephthalate film, covers the central portion 8 and is hot adhesive bonded to the reinforcement 9. The film extends into a free diaphragm surround 11 which is arched inwardly by hot forming, and may have approximately the shape of a portion of a torus. Beyond the surround 11 the film is hot formed and adhesive bonded to a ring-like diaphragm frame 12, which is shown in FIG. 3. The outer peripheral area of the film is trapped between the inner wall of the tube 1 and the adjacent outer wall of the frame 12. The outer surface of the central portion 8 of the diaphragm assembly is substantially coplanar with the rim of the tube 1.

There is no passageway through the diaphragm assembly 7, since this would be subject to plugging by cerumen. Instead, the necessary equalization of static pressure on each side of the diaphragm assembly is provided by the atmospheric vent 6.

When the transducer of FIG. 1 is in place within the ear of the user, a space is defined which is generally bounded by the ear canal, the tympanic membrane and the diaphragm assembly 7.

Referring to FIGS. 1 and 3 a particular electromechanical motor unit 13 is supported within the casing of the transducer. The motor unit 13 is preferably of the kind described in the copending application of George C. Tibbetts filed on even date herewith and entitled, "Balanced Armature Transducers with Transverse Gap." The motor unit 13 has a vibrating armature 13*a* connected to the stem 10 of the diaphragm assembly 7, and has internal electrical leads 14 and 15 extending to and soldered to the pads 4 and 5 respectively. The structural part fixed between the flanges of the tube 1 and cup 2 is the peripheral rim of a restoring spring 16 (FIGS. 1 and 3) of the motor unit 13. The restoring spring is preferably adapted to stabilize the armature against magnetic snap over, and has a hub attached to a pin 13*b* which is attached to both the armature 13*a* and the stem 10. The spring 16 has spokes extending from the hub to the peripheral rim. The rim and hub are substantially coplanar, but the spokes are formed along the longitudinal axis of the transducer to provide a sufficient degree of linearity to the force-deflection characteristic of the spring 16.

FIG. 3 details the mounting of the diaphragm assembly 7 in the tube 1. The formed skirt of the film that forms the diaphragm surround 11 and also covers the central portion 8, is trapped between the adjacent walls of the diaphragm frame 12 and the tube 1, and is adhesive bonded to both walls. In this way the surround 11 is very strongly attached against external pressure such as that due to end-user cleaning.

Figure 2:
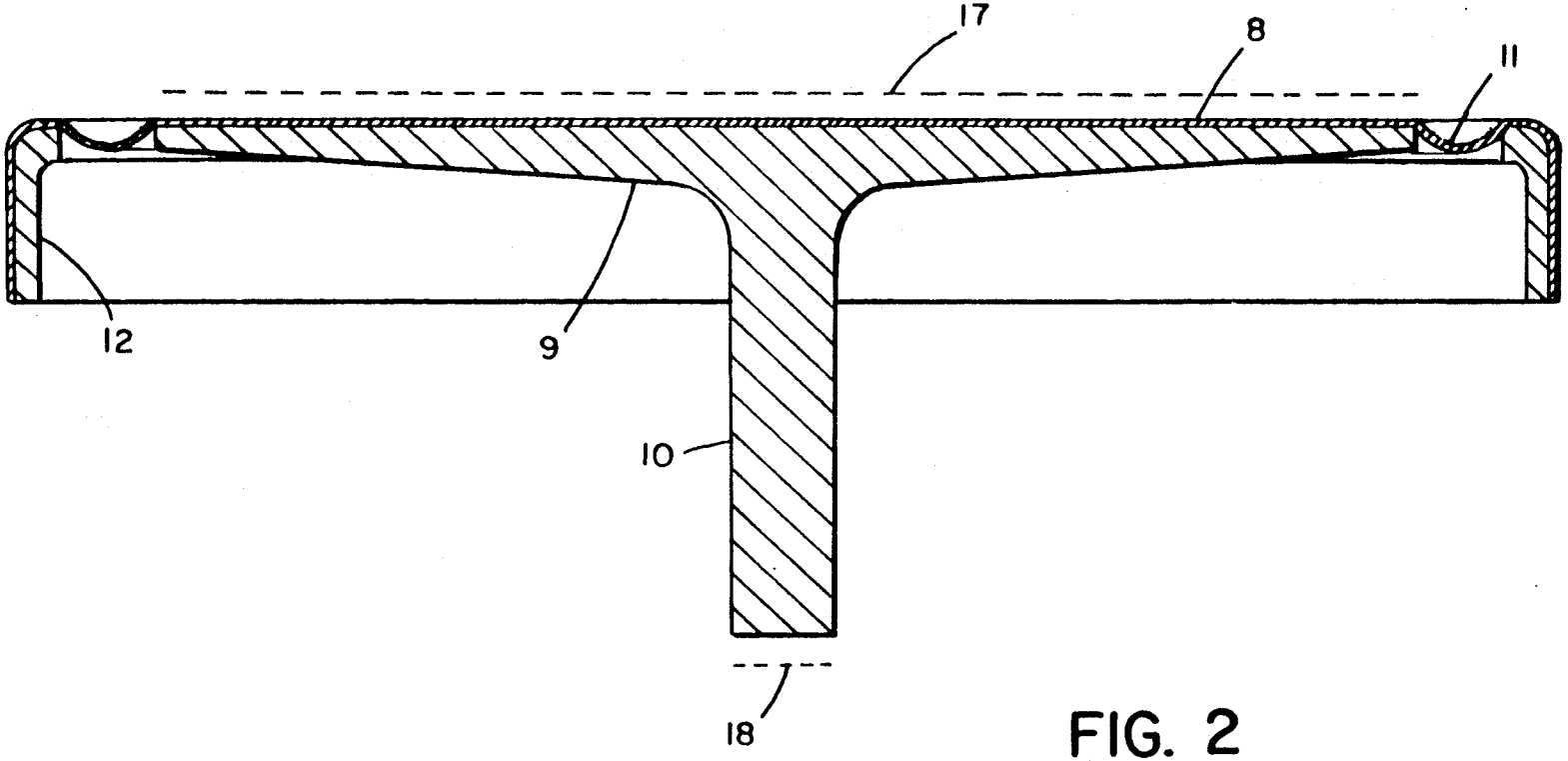
FIG. 2 is a detail elevation in diametric section of the diaphragm means of the first embodiment.

FIG. 2 is a plane section of the diaphragm assembly 7, with the film of the surround 11 exaggerated in thickness. Protection must be provided against excessive deflection of diaphragm reinforcement 9. In FIG. 2, for example, the desired limit on the upward deflection of the central portion 8 is illustrated by a broken line 17, and the desired limit on the downward deflection of the stem 10 is illustrated by a broken line 18. The causes of excessive deflection include, as in typical prior art transducers, acoustic shock and mechanical shock which can cause either direction of motion. For example, the peak shock load resulting from the dropping of a hearing aid can exceed several thousand G.

As in some prior art transducers, this invention contemplates that a mechanical stop function protecting against such specific causes may be provided by the electromechanical motor unit itself.

However, in the case of the present invention there is a third cause of excessive deflection, specifically deflection toward the line 18. This cause is external positive pressure applied by the user when cleaning cerumen from the outer face of the diaphragm assembly. This imposes an additional, severe requirement upon the means providing the mechanical stop function. According to this invention, this additional requirement may also be met by the electromechanical motor unit itself; or it may be met by additional mechanical stop means incorporated in the transducer structure. Structures of both forms are hereinafter described, and in either case the transducers of this invention are characterized by superior mechanical shock resistance as compared with typical prior art transducers.

With the diaphragm reinforcement 9 protected against excessive deflection, the free diaphragm surround 11 itself must withstand the external pressure due to end-user cleaning, particularly such pressure that tends to be localized where the surround 11 is not attached or supported. As shown in FIGS. 2 and 3, the surround 11 is well adapted to do this. It is strongly attached, its radial extent is relatively small, it is arched inward to avoid buckling under positive external pressure, and the arch is of high curvature to reduce the membrane stresses induced in the film of the surround during end-user cleaning.

FIG. 3 illustrates a structure in which the electromechanical motor unit 13 itself provides the necessary mechanical stop function for the diaphragm means. As described in said copending application, the motor unit includes a pair of permanent magnets 13*c* which establish polarizing flux acting in association with signal currents in coils 13*d* to vibrate the armature 13*a* in the axial direction of the pin 13*b*. The magnets 13*c*, or pole pieces attached to them, face the armature across working gaps as shown. By acting as mechanical abutments to the fully displaced armature, the magnets or their pole pieces establish the limits of motion of the diaphragm means corresponding to the lines 17 and 18 in FIG. 2.

Figure 4:
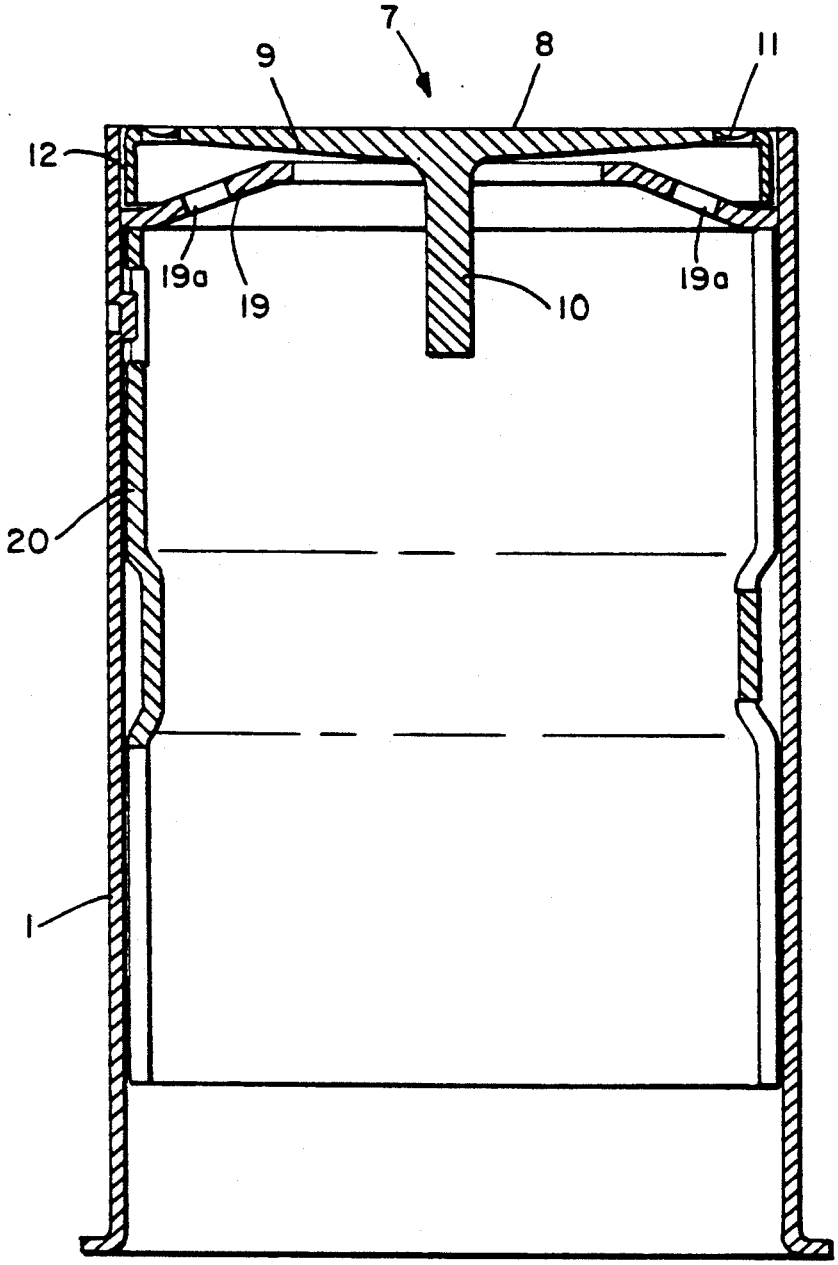
FIG. 4 is a partial elevation in diametric section showing an alternative form of mechanical stop means.

In cases where the electromechanical motor unit itself does not sufficiently limit the inward deflection of the diaphragm reinforcement 9, or tends to do so but is not strong enough under end-user cleaning, a mechanical stop is provided. FIG. 4 shows such a stop at 19. The stop 19 is a generally cone shaped washer formed to give it good self-strength, and typically it rests on another structural member, such as a sleeve 20, which is strongly attached within the tube 1. Alternatively the stop 19 may be laser welded in place through the wall of the tube 1. The stop 19 may have one or more perforations 19*a* to provide an acoustic passage or passages as the gap between diaphragm reinforcement 9 and the stop 19 approaches zero during electroacoustic operation of the transducer.

Figure 5:
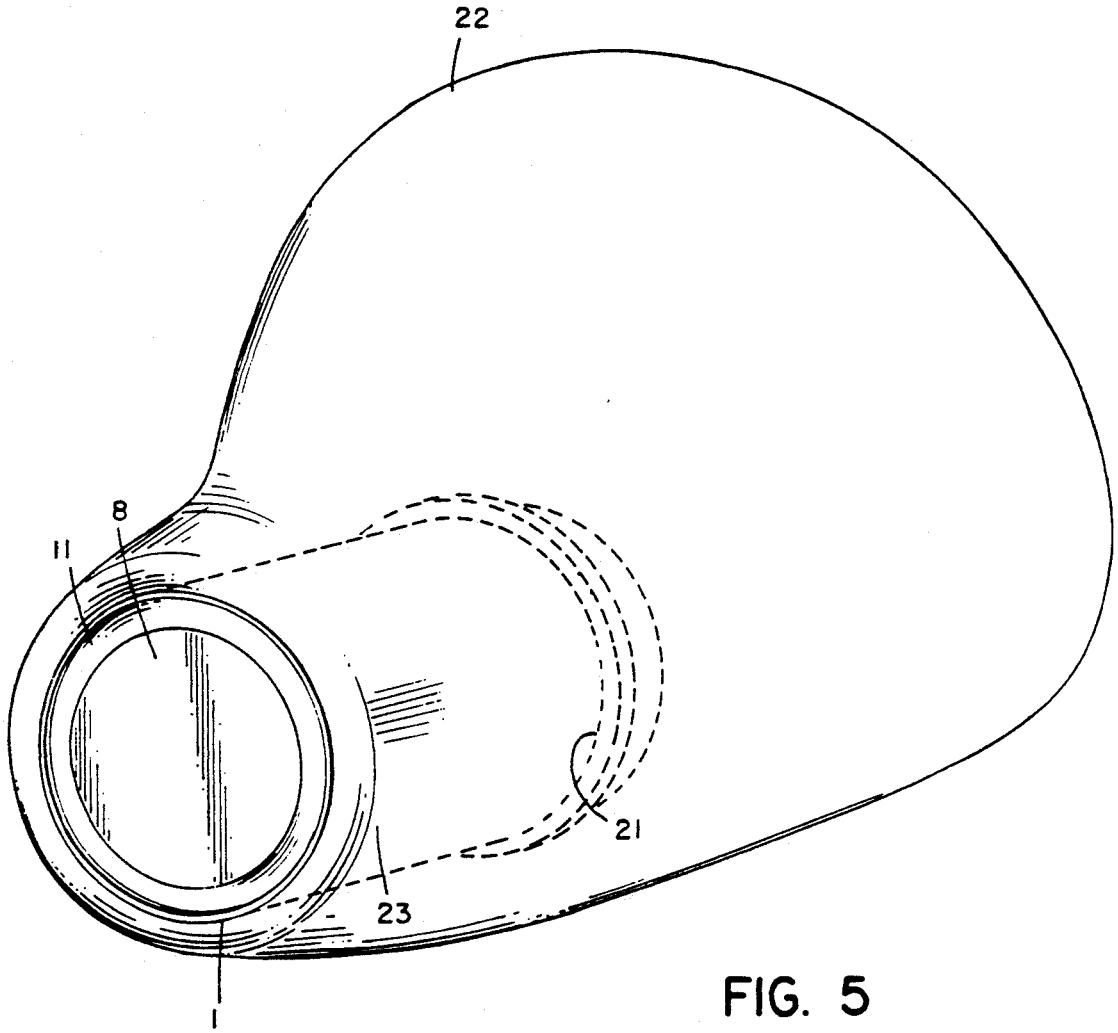
FIG. 5 is a composite view of an in-the-ear hearing aid incorporating said first embodiment.

FIG. 5 shows an application of a transducer 21, such as the transducer of FIG. 1, to a canal aid 22 having an inner end of its shell at 23. The inner end 23 faces toward the tympanic membrane when the canal aid 22 is inserted in the ear of the user. The transducer 21 is mounted within the canal aid 22, such that the central portion 8 of the diaphragm is substantially flush with the inner end 23. A temporary protective cap, not shown, may be provided. Cerumen accumulation on the exposed face of the diaphragm, including the diaphragm surround 11, will affect the shape of the frequency response of the transducer 21, and secondarily its sensitivity, but this contamination may be cleaned readily from the diaphragm by the end-user. Indeed, if the tube 1 of the transducer 21 is tightly sealed to the shell of the canal aid 22 at its inner end 23, detergent solutions used locally and followed by thorough rinsing and drying can be used to accelerate cleaning.

Figure 6:
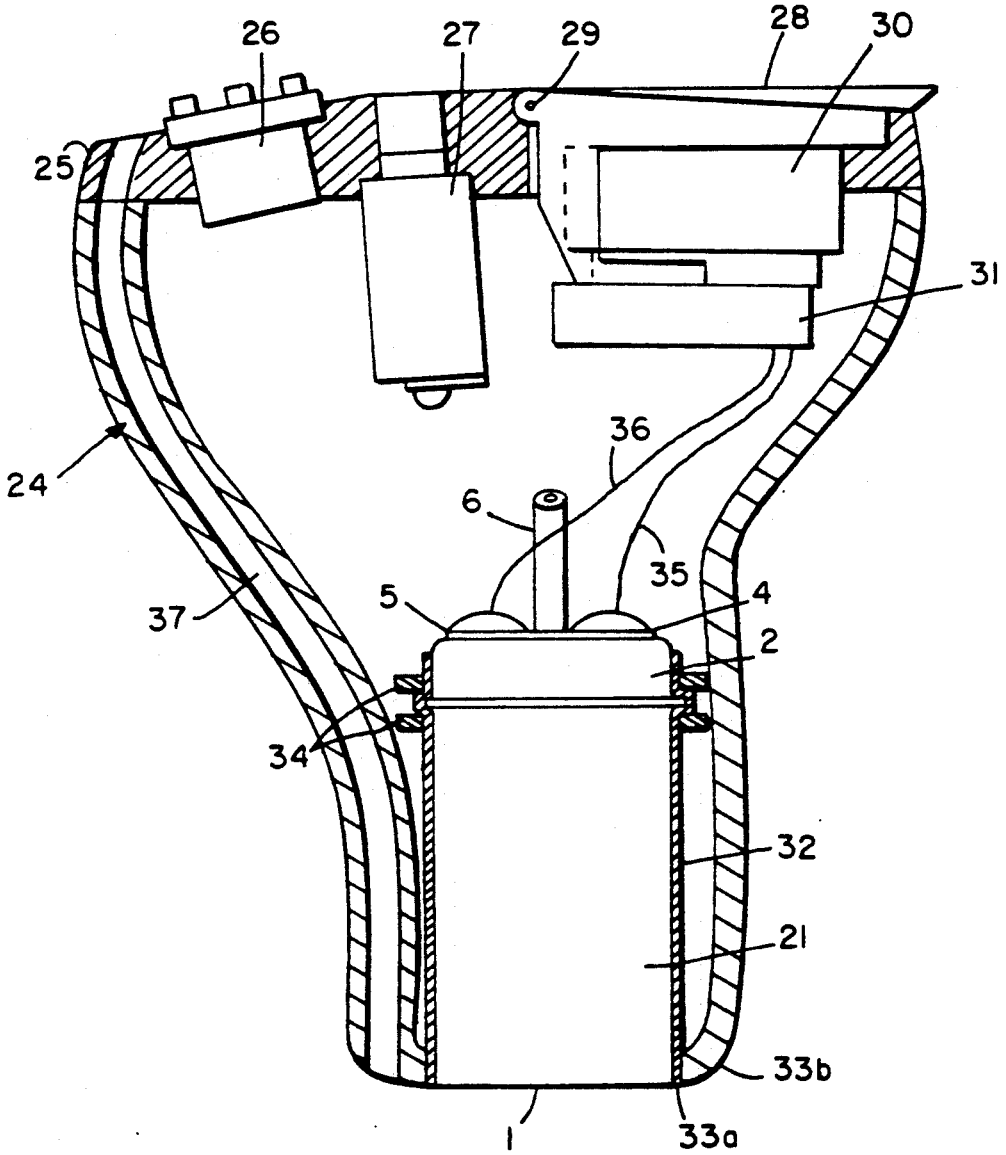
FIG. 6 is a composite view and elevation in section of a hearing aid similar to that of FIG. 5.

FIG. 6 shows a similar substantially flush mounted application of the transducer 21 to a canal aid 24 having its shell bonded to a face plate 25. The face plate contains a volume control 26, an electret microphone 27, and a battery compartment 28 hinged at 29 and containing a single cell battery 30. A semiconductor amplifier 31 is bracketed to the face plate 25. Thin wall silicone rubber tubing 32 is shrunk over the casing of the transducer 21, and seals it at 33*a* to the end wall 33*b* of the shell of the canal aid 24. Silicone sealant may also be applied at 33*a*.

Clamps, schematically indicated at 34, grip the tubing 32 where it forms over the flanges of the tube 1 and cup 2, and resiliently clamp the transducer 21 to the shell of the canal aid 24. The silicone rubber tubing 32 provides some vibration isolation . between the transducer 21 and the shell of the canal aid 24. Flexible external electrical leads 35 and 36 are soldered to pads 4 and 5 respectively, and connect to the amplifier 31. Other electrical connections within the canal aid 24 are conventional and for clarity are not shown. The atmospheric vent 6 preferably is fabricated from small polytetrafluoroethylene sheathed stranded wire, the sheath of which has been etched to allow adhesive bonding to the terminal cup 2. The use of this polymer sheathing permits the proximate soldering of the leads 35 and 36, and provides flexibility to the vent 6, while the stranded wire core provides a reasonably controlled flow resistance to the atmospheric vent 6. Ordinarily the canal aid 24 is not gas tight, and therefore the ambient atmospheric pressure is communicated to the vent 6. After the leads 35 and 36 are soldered, and most of the operations that might plug the atmospheric vent 6 are finished, but before the face plate 25 is bonded to the shell of the canal aid 24, the vent is shortened and provided with a fresh outer end by snipping it to the desired length.

An additional, acoustically active vent 37 may bypass the transducer 21 and extend through the face plate 25 and the end wall 33*b*.

Such vent means is commonly used to relieve excess static pressure in the ear canal, to ventilate the ear canal somewhat, and to modify the overall frequency response of the particular hearing aid, such as canal aid 24.

Figure 7:
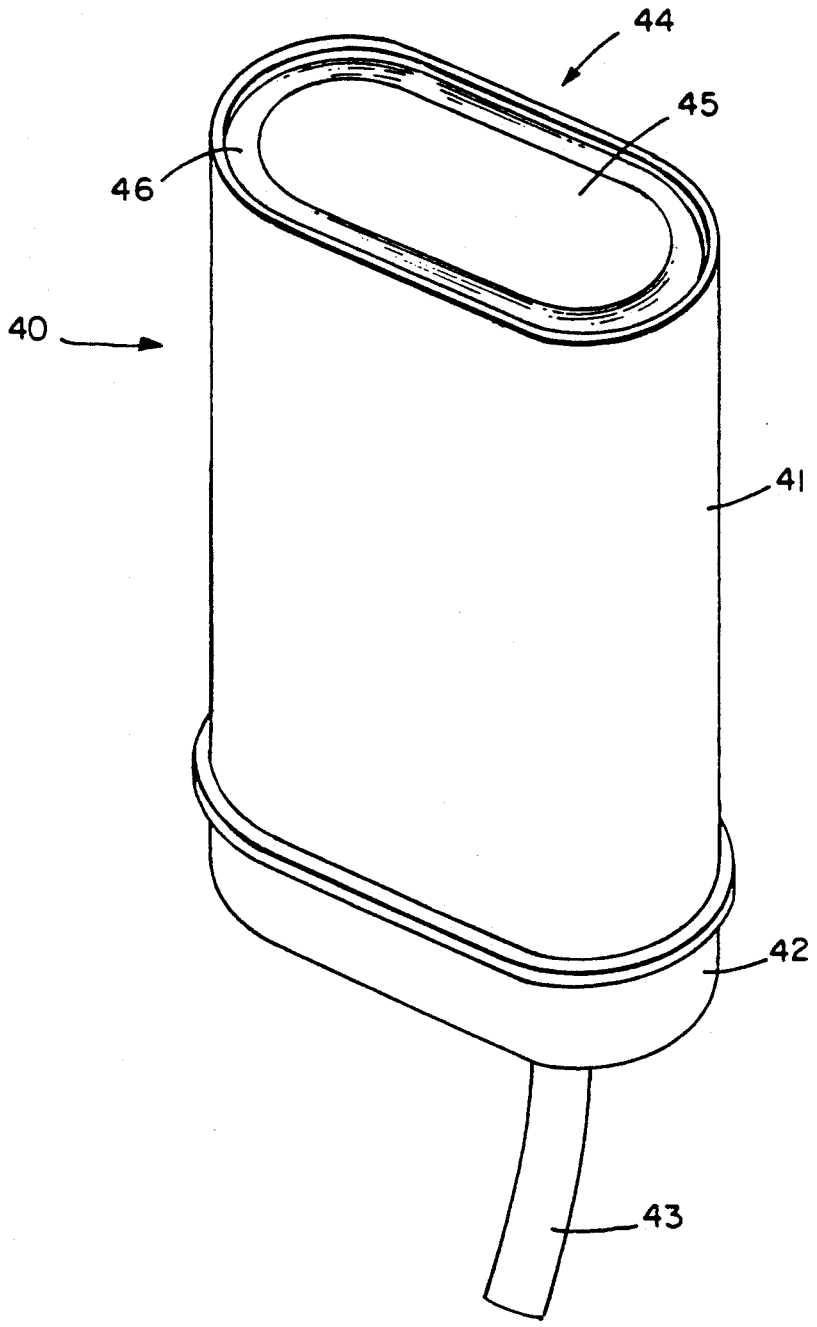
FIG. 7 is an isometric view of a second embodiment of a transducer according to the invention.

The transducers of the present invention need not have a casing of substantially cylindrical shape, and the casing need not have flanges, but such transducers may have a casing of any shape that is useful within the ear canal or within a device to be inserted in the ear canal. However, because of the general shape of the human ear canal, a transducer casing of substantially cylindrical shape which has an oval cross section is particularly useful in these end applications, and is relatively straightforward to manufacture. FIG. 7 shows an isometric view of a transducer having such a casing. The rim of the casing lies substantially in a plane and its outline comprises substantially a pair of semicircles smoothly connected by parallel lines. Flanges are shown, although other means may be employed to close or complete the casing at its terminal end.

Thus FIG. 7 shows a transducer 40 cased by a flanged tube 41 and flanged cup 42, both of oval cross section. An atmospheric vent 43 extends through the end wall of the cup 42. A diaphragm assembly 44 has an oval central portion 45 defined by a diaphragm reinforcement which, as in the embodiments of FIGS. 1 to 4, attaches internally to an electromechanical motor unit within the casing of the transducer 40. Thin film covers the central portion 45, where it is bonded to the underlying diaphragm reinforcement, and extends outward to form a concave diaphragm surround 46. Outwardly of the surround 46 the film is sealed to the interior wall of the tube 41. There is no aperture through the diaphragm assembly 44.

Figure 8:
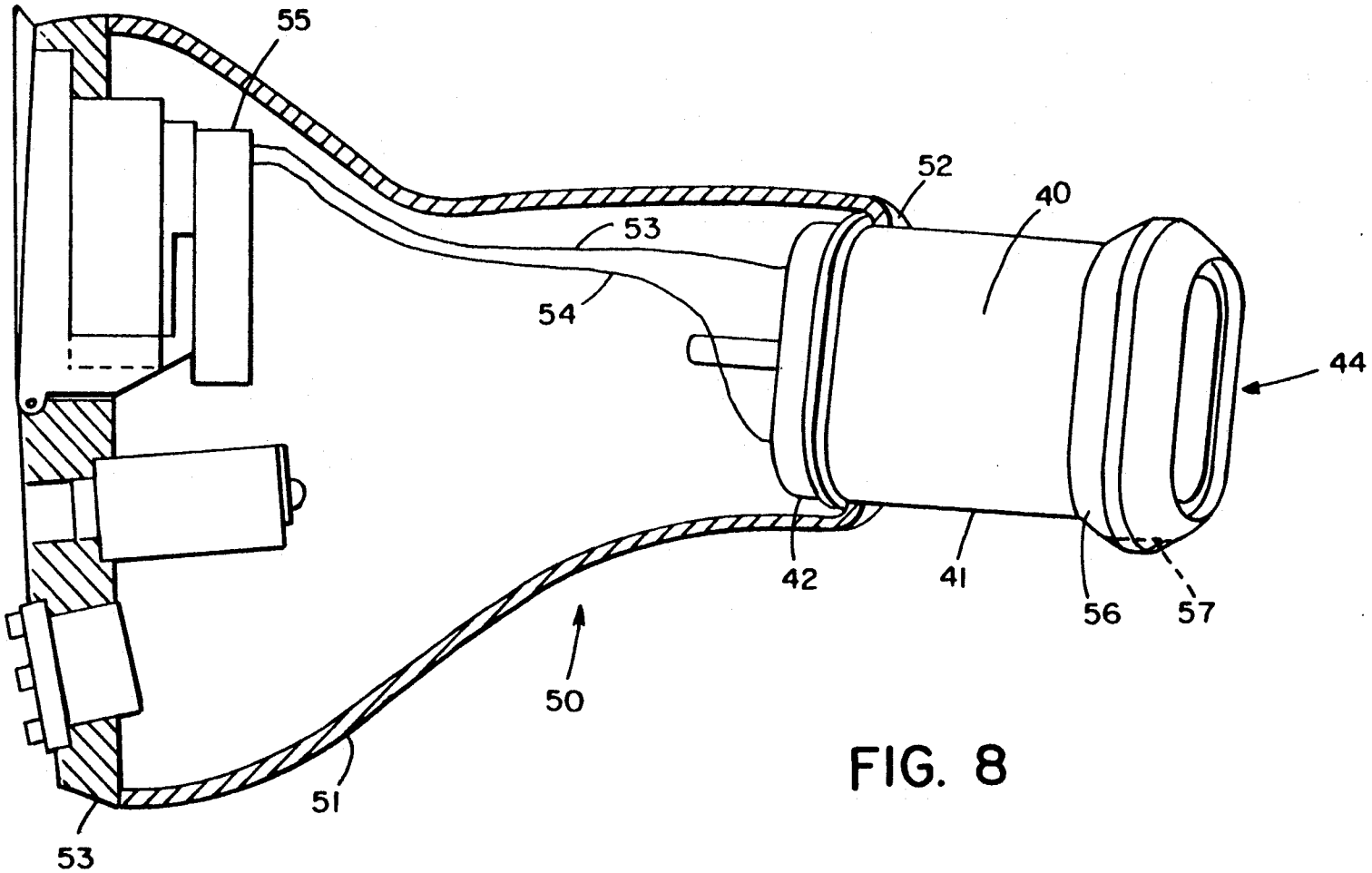
FIG. 8 is a composite view and elevation in section of a deep insertion canal aid incorporating said second embodiment.

In FIG. 8 the transducer 40 of FIG. 7 is used to provide a new type of deep insertion canal aid 50. The nominal shell 51 of the canal aid 50 has an end wall 52 which is apertured to accept the transducer 40. Prior to the bonding of a face plate 53 to the shell 51 and prior to the attachment of a seal 56, the tube 41 of the transducer is inserted through this aperture until the flange of the tube 41 abuts the interior of the wall 52. Unlike the canal aid of FIG. 6, the flanges of the tube 41 and cup 42 are bonded to the wall 52 and an adjacent portion of the shell 51 with a substantially rigid adhesive, thus locking the transducer 40 strongly in place. Electrical lead 54 connect the respective terminals pads of the transducer 40 to an amplifier 55. Since much of the tube 41 is exposed to the environment of the ear canal, it is gold plated or otherwise coated so as to be inert and non-sensitizing to the ear canal.

With most of the tube 41 extending beyond the end wall 52, as shown in FIG. 8, the wall of the tube 41 becomes in effect a portion of the shell of the canal aid 50. The significance of this is that the tube 41 is smaller in cross section than any shell that could surround it, and the reduction in size enables the diaphragm assembly 44 to be inserted more deeply toward the tympanic membrane.

This reduces the parasitic air volume between the diaphragm assembly 44 and the tympanic membrane, and has the effect of increasing the electroacoustic sensitivity of the transducer 40. This structural combination also allows the use of an optional peripheral seal 56 which is local in extent, resulting in a more effective, and at times more comfortable, seal to the ear canal. Typically the seal 56 is a prescription molding, to fit the individual user's ear, of low durometer medical grade silicone rubber, and it extends slightly beyond the diaphragm assembly 44 and has an internal step which covers the extreme tip of the tube 41, to protect the ear canal of the user from that end of the tube 41. The seal 56 may be designed to snap off and on, or it may be bonded to the tube 41 with a suitable adhesive or sealant. The seal 56 may have a venting notch 57 to relieve excess static pressure in the ear canal. A notch of this type in the seal 56 is subject to plugging by cerumen, but is readily cleaned by the user. For the venting notch 57 to be effective, the canal aid 50 may have a bypass vent similar to the vent 37 discussed with reference to the canal aid 24 of FIG. 6. As an alternative to the seal 56 notched at 57, the seal may be fabricated from an open pore flexible foam of polymeric material such as a polyurethane. The porosity of the foam provides venting but will become plugged by cerumen accumulation. Seals of this type must be designed to be readily removed and replaced by the user.

Although the transducers illustrated in the above FIGURES are intended as output transducers, the structures of this invention are also applicable as so-called in-the-ear microphones, in which the input signal to the transducer is the acoustic pressure resulting from tissue and bone vibrations within the blocked ear canal and caused by the wearer's voice.

We claim:

1. An electroacoustic transducer comprising, in combination, a casing having a wall of hollow tubular shape and diaphragm means substantially closing and sealing the casing near one end thereof, the casing being shaped for insertion in the ear to define a space generally bounded by the ear canal, the tympanic membrane and the diaphragm means, the diaphragm means comprising a central portion with its peripheral edge spaced from said wall and a thin, flexible film extending from said edge toward said wall to form a surround, the surround being formed inwardly of the casing interior to provide elastic stability to the surround under external pressure, and an electromechanical motor supported within the casing and having a vibratory member connected to said central portion, the transducer further having stop means adapted to limit the movement of said central portion inwardly of the casing to a substantially predetermined extent.

2. A transducer according to claim 1, in which the interior of the casing is vented near the other end thereof.

3. A transducer according to claim 1, having a passage external to the casing for venting said space to the ambient atmospheric pressure.

4. A transducer according to claim 1, in which the film extends over substantially the entire area of said one end of the casing.

5. A transducer according to claim 1, in which the vibratory member comprises an armature connected to the central portion of the diaphragm means and the stop means comprises a part of the motor located to arrest the armature upon its deflection to a predetermined extent in the direction inwardly of the casing.

6. A transducer according to claim 1, in which said wall of the casing is of substantially cylindrical shape.

7. A transducer according to claim 1, in which the stop means comprises a member secured to and within the wall of the casing and located in position to limit the inward deflection of the central portion of the diaphragm means.

8. A transducer according to claim 7, in which the stop means is perforated for acoustic communication between the diaphragm means and the casing interior.

9. A transducer according to claim 1, in which the casing wall forms a rim at said one end thereof, and the outer surface of the central portion of the diaphragm means is substantially coplanar with said rim.

10. A transducer according to claim 6, in which said wall of the casing has a substantially circular cross section and the central portion of the diaphragm means has a substantially circular periphery.

11. A transducer according to claim 1, in which the casing wall forms a rim at said one end thereof and the outline of the rim is substantially non-circular.

12. A transducer according to claim 11, in which said rim lies substantially in a plane and said outline comprises substantially a pair of semicircles smoothly connected by parallel lines.

13. A transducer according to claim 1, including a cup shaped member closing the other end of the casing and having a vent therethrough.

14. A transducer according to claim 13, in which the casing and cup shaped member are each flanged and the flanges thereof are mutually attached.

15. A transducer according to claim 5, in which a restoring spring is also connected to the armature, the restoring spring comprising an annular rim with flexible spokes extending inward for connection to the armature, and including a cup shaped member closing the other end of the casing and being attached with said rim thereto.

16. A transducer according to claim 1, including a ring shaped frame within the casing, the film external to the surround being formed to fit over the frame and to be held thereby in cooperation with the inner wall of the casing.

17. A hearing aid comprising, in combination, a shell formed to fit in the ear with an aperture on one end directed toward the tympanic membrane, a microphone mounted to the shell and an electrical amplifier electrically connected to the microphone, a casing having a wall of hollow tubular shape secured within and substantially sealed to said aperture, and diaphragm means substantially closing and sealing the casing near one end thereof, the shell and casing being shaped for insertion in the ear to define a space generally bounded by the ear canal, the tympanic membrane and the diaphragm means, the diaphragm means comprising a central portion with its peripheral edge spaced from said wall and a thin, flexible film extending from said edge toward said wall to form a surround, and an electromechanical motor electrically connected to the amplifier, supported within the casing and having a vibratory member connected to said central portion, the hearing aid further having stop means adapted to limit the movement of said central portion inwardly of the casing to a substantially predetermined extent.

18. A hearing aid according to claim 17, in which the interior of the casing is vented to the interior of the shell and the interior of the shell has effective communication with the ambient atmospheric pressure.

19. A hearing aid according to claim 17, having a passage external to the casing for venting said space to the ambient atmospheric pressure.

20. A hearing aid according to claim 17, in which the film extends over substantially the entire area of said one end of the casing.

21. A hearing aid according to claim 17, in which the casing has an end closure vented to the interior of the shell and provided with terminals connecting between the amplifier and the motor.

22. A hearing aid according to claim 17, in which the casing is located substantially internal to the shell and the diaphragm means is exposed at said aperture.

23. A hearing aid according to claim 17, in which the surround is formed inwardly of the casing interior to provide elastic stability to the surround under external pressure.

24. A deep insertion hearing aid according to claim 17, in which a substantial portion of the wall of the casing is external to the shell.

25. A deep insertion hearing aid according to claim 24, including a resilient annular acoustic seal surrounding the casing near said one end thereof and formed to engage the wall of the ear canal.

26. A deep insertion hearing aid according to claim 25, in which the acoustic seal has a passage for venting said space to the ambient atmospheric pressure.

27. A deep insertion hearing aid according to claim 25, in which the acoustic seal is disposable and comprises porous polymeric foam.

28. A hearing aid comprising, in combination, a shell formed to fit in the ear with an aperture on one end directed toward the tympanic membrane, a microphone mounted to the shell and an electrical amplifier electrically connected to the microphone, a diaphragm means substantially closing and sealing the aperture near said one end of the shell, the shell being shaped for insertion in the ear to define a space generally bounded by the ear canal, the tympanic membrane and the diaphragm means, the diaphragm means comprising a central portion with its peripheral edge spaced from said aperture and a thin, flexible film extending from said edge toward said shell to form a surround, the surround being formed inwardly of the shell interior, and an electromechanical motor electrically connected to the amplifier, supported within the shell and having a vibratory member connected to said central portion, the hearing aid further having stop means adapted to limit the movement of said central portion inwardly of the shell to a substantially predetermined extent.

29. A hearing aid according to claim 28, having a passage for venting said space to the ambient atmospheric pressure.

* * * * *

UNITED STATES PATENT AND TRADEMARK OFFICE

CERTIFICATE OF CORRECTION

PATENT NO. : 5,220,612

DATED : June 15, 1993

INVENTOR(S) : George C. Tibbetts and Peter L. Madaffari

It is certified that error appears in the above-identified patent and that said Letters Patent is hereby corrected as shown below:

Column 6, line 58, change "lead" to "leads".

Drawing:

Fig. 8, delete the reference numeral "53" designating an electrical lead and designate such lead as "54".

Signed and Sealed this

Fifteenth Day of March, 1994

Bruce Lehman

BRUCE LEHMAN

*Commissioner of Patents and Trademarks*

*Attest:*

*Attesting Officer*